United States Patent [19]

Christopherson

[11] Patent Number: 4,458,472

[45] Date of Patent: Jul. 10, 1984

[54] LAWN MOWER ZONE START SYSTEM

[75] Inventor: Herman P. Christopherson, Burnsville, Minn.

[73] Assignee: The Toro Company, Minneapolis, Minn.

[21] Appl. No.: 382,025

[22] Filed: May 26, 1982

[51] Int. Cl.[3] ..... F02N 3/02

[52] U.S. Cl. ..... 56/10.5; 123/179 SE

[58] Field of Search ..... 56/10.5, 13.7, 320.1, 56/320.2; 123/179 SE, 185 BA, 185 A

[56] References Cited

U.S. PATENT DOCUMENTS

| | | | |
|---|---|---|---|
| 2,912,966 | 11/1959 | Mitchell | 123/179 SE |
| 3,375,338 | 3/1968 | Delf | 56/10.5 |
| 4,109,538 | 8/1978 | Glenday | 123/179 SE |
| 4,242,855 | 1/1981 | Beaver, Jr. | 56/13.7 |

FOREIGN PATENT DOCUMENTS

| | | | |
|---|---|---|---|
| 47417 | 3/1982 | European Pat. Off. | 56/10.5 |

*Primary Examiner*—Jay N. Eskovitz

*Attorney, Agent, or Firm*—James W. Miller

[57] ABSTRACT

A rotary lawn mower (2) having an internal combustion engine (8) that includes a recoil starter (17) has a zone start system (20 or 40) for supporting the pull grip (19) of the starter (17) on the handle assembly (12) of the mower (2). Zone start system (20 or 40) each includes a bracket (22 or 52) for releasably securing the pull grip (19) to one handle tube (15) of the handle assembly (12). Pull grip (19) can be easily detached from the brackets (22 or 52) and moved to a non-interfering position such that a rear bagging attachment (10) can be easily removed from the lawn mower (2) for the dumping of grass clippings.

8 Claims, 8 Drawing Figures

FIG. 1
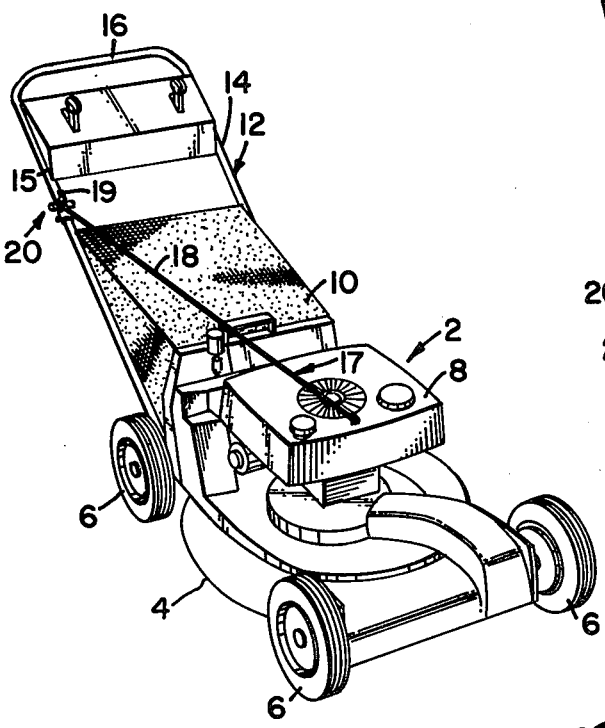
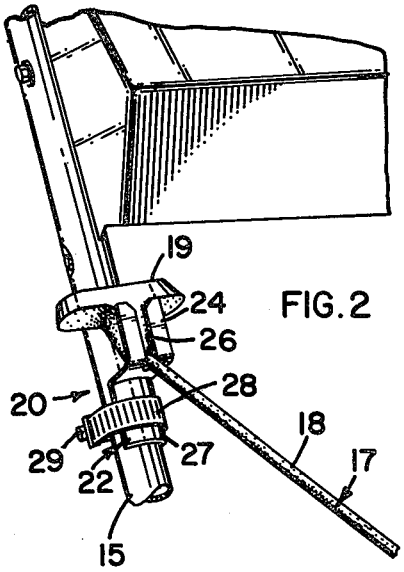
FIG. 2
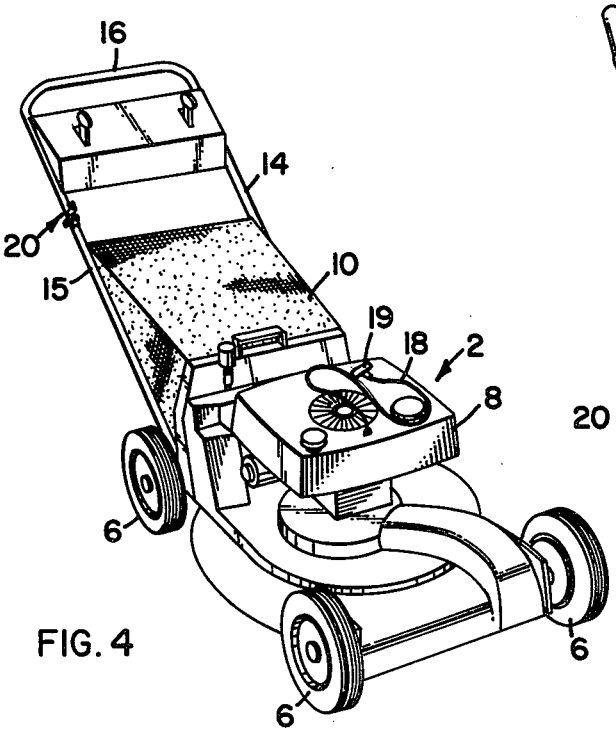
FIG. 4
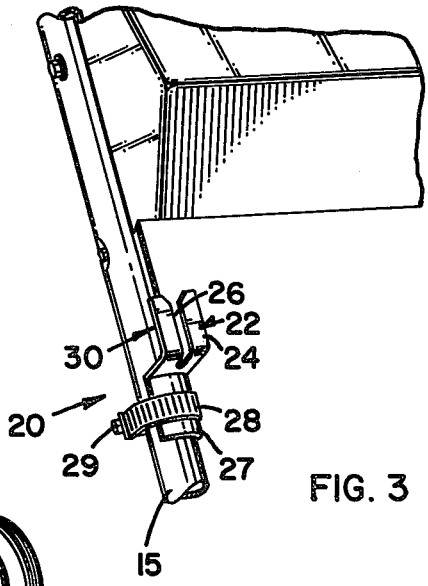
FIG. 3

LAWN MOWER ZONE START SYSTEM

TECHNICAL FIELD

This invention relates to a recoil starter for the internal combustion engine of a rotary lawn mower. More particularly, this invention relates to such a starter which can be conveniently actuated from the handle assembly of the lawn mower, e.g. a zone start system.

DESCRIPTION OF THE PRIOR ART

Rotary lawn mowers are well known for cutting grass or other ground growing vegetation. They typically comprise a wheeled chassis or housing having an enclosed cutting chamber. A cutting element, such as a rigid steel blade or flexible filament cutting line, is supported in the cutting chamber for rotation in a horizontal cutting plane. An internal combustion engine is often the power source for the cutting element and is bolted to the top of the lawn mower housing. The drive shaft of the engine extends down into the cutting chamber and is secured to the cutting element. Such internal combustion engines often utilize a recoil rope starter of any generally conventional design.

When using the conventional recoil rope starter to start the engine, the operator has to place one foot on top of the lawn mower housing to get sufficient leverage when pulling the rope to start the engine. This has been a frequent source of lawn mower injuries since the operator's foot can slip off of the top of the housing and fall into the cutting chamber where it is likely to be struck by the rotating blade and injured if the lawn mower engine should start. It has been recognized that it would be safer to have the recoil rope starter accessible to the operator when he is standing in back of the handle assembly on the lawn mower relatively far away from the housing. U.S. Pat. No. 2,912,966 to Mitchell discloses such an arrangement where the rope of the recoil starter is threaded back around a pulley or guide tube to a position where the pull grip at the end of the rope is located on the handle assembly of the lawn mower. Thus, the operator need not place his foot on the housing, but may stand behind the handle assembly while starting the engine.

U.S. Pat. No. 4,109,538 to Glenday discloses a further refinement of the concept shown in Mitchell. In Glenday, the rope of the recoil starter extends from the engine rearwardly back to the handle assembly. Moreover, the handle assembly is a more modern U-shaped design having transversely spaced apart left and right handle tubes connected together at their top by a transversely extending handle member. The rope in Glenday is threaded through a bracket contained on the right handle tube of the handle assembly so that a right handed person can easily pull the rope. Moreover, the bracket which contains the rope has an extension that can engage the ground during the starting operation for bracing purposes.

While both Mitchell and Glenday disclose locating the pull grip of the recoil rope starter on the handle assembly of the lawn mower, neither one of them would be applicable to the types of lawn mowers in the market today having rear bagging attachments. Such attachments comprise relatively bulky bags or containers located between the handle tubes of the handle assembly and are coupled to a grass clippings discharge port on the housing. The arrangement of the ropes in both devices would interfere with the bagging attachment and make the attachment difficult to remove as is necessary in a grass dumping operation. Accordingly, before the present invention, the zone start system did not appear to be compatible with rear bagging lawn mowers.

SUMMARY OF THE INVENTION

It is an aspect of this invention to provide a recoil rope starter for a rotary lawn mower in which the recoil rope starter can be used in a zone start system but does not interfere in any way with a rear bagging attachment on the lawn mower.

A lawn mower according to this invention comprises a movable housing. An internal combustion engine is used on the housing to power the cutting element. A handle assembly extends upwardly and rearwardly from the housing and is U-shaped comprising spaced apart left and right handle tubes connected together adjacent their upper ends by a transversely extending handle member. A rear bagging attachment is releasably coupled to the housing for receiving and collecting cut particles. A recoil starter is provided as part of the internal combustion engine which starter includes an elongated starter rope having a pull grip at its outer end. The invention relates particularly to a zone start system which comprises means for normally retaining the pull grip of the starter rope on one of the handle tubes of the handle assembly at a location which is accessible to an operator who is holding the handle member for easy starting of the engine. The retaining means includes means for releasing the pull grip from the one handle tube for movement of the starter rope to a non-interfering position with the bagging attachment when it is desired to remove the bagging attachment from the housing for dumping of the attachment.

BRIEF DESCRIPTION OF THE DRAWINGS

This invention will be described hereafter in the following Detailed Description, when taken in conjunction with the following drawings, in which like reference numerals refer to like elements throughout.

FIG. 1 is a perspective view of a lawn mower according to this invention, particularly illustrating a recoil starter located on the handle assembly of the mower in a first embodiment of a zone start system;

FIG. 2 is a perspective view of a portion of the recoil starter shown in FIG. 1, particularly illustrating the pull grip of the recoil starter rope located in a bracket of the zone start system;

FIG. 3 is a perspective view of a portion of the recoil starter shown in FIG. 1, particularly illustrating the construction of the bracket of FIG. 2;

FIG. 4 is a perspective view of the lawn mower of FIG. 1, particularly illustrating the starter rope as being disengaged from the bracket of the zone start system to allow easy removal of the bagging attachment;

DETAILED DESCRIPTION

Figure 5:
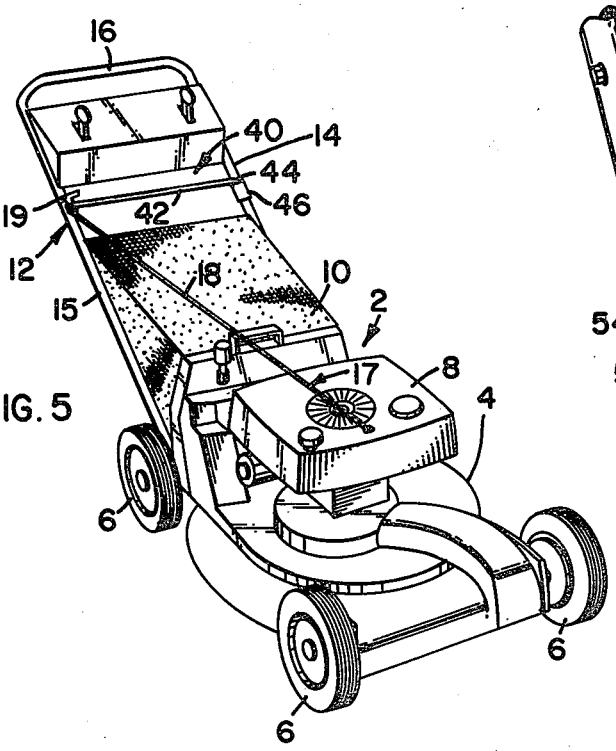
FIG. 5 is a perspective view of a lawn mower according to this invention, particularly illustrating a recoil starter located on the handle assembly of the mower in a second embodiment of a zone start system.

Referring first to FIG. 1, an improved rotary lawn mower according to the present invention is generally illustrated as 2. Lawn mower 2 may be of any conventional type having a housing 4, wheels 6 for movably supporting housing 4, an internal combustion engine 8 carried on the top of housing 4 for rotating a cutting element (not shown) contained in a cutting chamber beneath housing 4, a rear bagging attachment 10 releasably coupled to a discharge port on housing 4 for receiving and collecting cut grass particles, and an upwardly and rearwardly extending handle assembly 12 which the operator can grasp while guiding housing 4 over the ground. Handle assembly 12 is preferably U-shaped having left and right handle tubes 14 and 15 connected integrally together at their top by a transversely extending handle member 16. A deadman handle (not shown) is pivotably connected to handle assembly 12 so that an operator who is gripping handle member 16 can squeezably close the deadman handle to operate a traction drive and/or a blade brake clutch unit on the mower. In addition, engine 8 contains a conventional recoil rope starter 17 that includes a starter rope 18 having a pull grip 19 at its outer end. Recoil starter 17 is of any generally conventional type such that the starter rope 18 is normally wound onto a spool or the like contained in engine 8 after the engine is started. To start the engine the operator holds onto pull grip 19 and pulls rope 18 outwardly relative to the engine 8.

The details of lawn mower 2 are not important to the present invention, which comprises a zone start system for supporting pull grip 19 of the recoil starter on the handle assembly 12. Zone start refers to a system in which pull grip 19 is located on handle assembly 12 within easy reach of handle member 16, e.g. 24 inches or less. This allows an operator who is holding handle member 16 to start engine 8 without coming around and placing his foot on the housing 4 as would have been the case with prior art mowers. Thus, all of the details of mower 2 may vary from that shown as long as it is in fact provided with a recoil starter 17 having a starter rope 18 of sufficient length, for the purposes noted hereafter.

FIGS. 1–4 depict a first embodiment of a zone start system according to this invention referred to as 20. Zone start system 20 comprises a bracket 22 that normally retains pull grip 19 on handle assembly 12. Bracket 22 comprises an upwardly extending tang 24 in which a vertical open-ended slot 26 is cut. Bracket 22 includes a mounting flange 27 shaped to conform to the curvature of handle tube 15. An elongated strap 28 surrounds flange 27 and includes a threaded clamping nut 29. When nut 29 is tightened, strap 28 will shorten until flange 27 is clamped against handle tube 15 to fixedly secure bracket 22 to handle tube 15. Preferably, bracket 22 is located on handle tube 15 within 24 inches of handle member 16.

Referring to FIG. 3, tang 24 of bracket 22 is spaced forwardly away from handle tube 15 to define a grip receiving recess 30. Recess 30 is open-ended at the top thereof as is vertical slot 26. As shown in FIGS. 1 and 2, starter rope 18 can be extended from engine 8 until grip 19 is received in the grip receiving recess 30 behind tang 24 with the starter rope 18 then extending forwardly through slot 26. In this position, rope 18 clears the top of bagging attachment 10 with pull grip 19 being conveniently located close to the operator's hands as the operator stands behind handle assembly 12. To start the mower, all the operator has to do is reach down and grab pull grip 19, remove pull grip 19 and starter rope 18 from bracket 22 by lifting up, and then pull upwardly on starter rope 18 while standing behind the handle assembly and gripping the deadman handle. Once engine 8 starts, the operator can replace pull grip 19 in the grip receiving recess 30 of bracket 22 and use both hands on the handle member 16 during a mowing operation.

One important advantage of zone start system 20 is the ability to easily remove bagging attachment 10 when it becomes full of grass clippings to dump it. The operator simply lets go of the deadman handle by releasing handle member 16 in which case the engine 8 on lawn mower 2 will automatically shut off due to an engine kill switch operated by the deadman handle. To avoid any interference between starter rope 18 and bagging attachment 10, the operator need only remove pull grip 19 from bracket 22 and lay starter rope 18 in any suitable non-interfering position, e.g. on top of engine 8 as shown in FIG. 4. This then frees the bagging attachment 10 for easy removal without any interference from the recoil starter 17. Accordingly, the safety features of the zone start system 20 are preserved in a lawn mower having a removable rear bagging attachment.

Referring now to FIGS. 5–8, a second embodiment of a zone start system according to this invention is illustrated as 40. Those elements of the lawn mower shown in FIGS. 5–8 which are identical to the lawn mower 2 shown in FIGS. 1–4 will be identified by identical reference numerals. The only difference between the two embodiments is a different manner of supporting the pull grip 19 and starter rope 18 on handle assembly 12 and a different manner for removing starter rope 18 to a non-interfering position.

Figure 6:
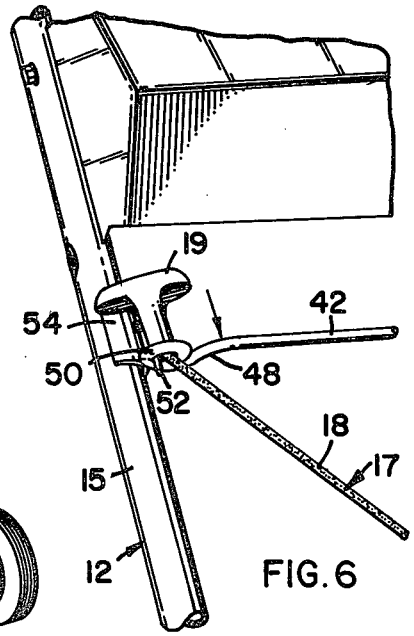
FIG. 6 is a perspective view of a portion of the recoil starter shown in FIG. 5, particularly illustrating a pivot rod of the zone start system and a latching bracket therefor.
Figure 7:
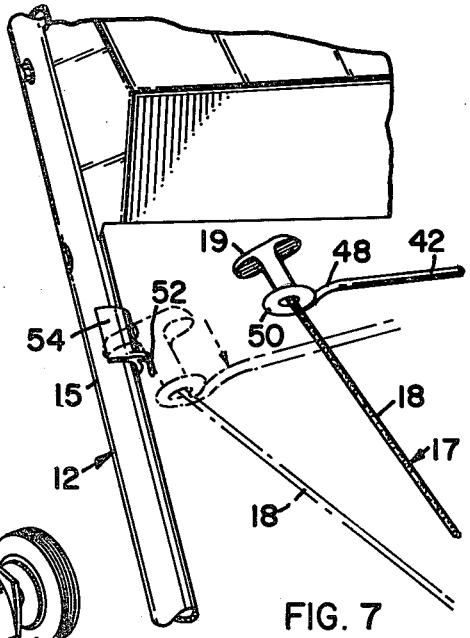
FIG. 7 is a perspective view of a portion of the recoil starter shown in FIG. 5, particularly illustrating the pivot rod of the zone start system as being disengaged from the latching bracket.

Zone start system 40 as illustrated in FIGS. 5–8 comprises a pivot rod 42 pivotally connected by a first downwardly turned end 44 to left handle tube 14. The first downwardly turned end 44 is rotatably received in a pivot sleeve 46 fixed on handle tube 14. The other end 48 of the rod 42 is a free end formed in the shape of a circular eyelet 50 as shown in FIGS. 6 and 7. Starter rope 18 extends rearwardly from engine 8 with the rope 18 passing through the circular eyelet 50 and pull grip 19 being supported above the eyelet 50 and being too large to pass through the eyelet. See FIG. 6.

A means is provided for releasably latching the free end 48 of pivot rod 42 to the right handle tube 15. This latching means is a bracket which comprises a downwardly extending tongue 52 which is formed on the lower end of a semi-circular mounting sleeve 54. Sleeve 54 is shaped to be received around handle tube 15 and bolted thereto such that tongue 52 points downwardly and is spaced away from handle tube 15 by a small distance. See FIG. 7. Tongue 52 is adapted to be inserted through eyelet 50 next to pull grip 19 to releasably latch the pivot rod 42 to the handle tube as shown in FIG. 6. While tongue 52 is a preferred form of latching means, any other suitable type of latch, e.g. a magnetic latch, could be used.

When eyelet 50 is received on tongue 52, the operator can easily start engine 8 merely by reaching down and grabbing pull grip 19 and pulling outwardly on starter rope 18. After engine 8 starts the rope 18 when released will retract until pull grip 19 engages eyelet 50 and is stopped thereon. When it is desired to remove bagging attachment 10 for dumping, all the operator has to do is place his hand on the middle of the rod 42 between the handle tubes 14 and 15 and push downwardly until eyelet 50 disengages tongue 52. There is an upward biasing force on rod 42 which normally keeps eyelet 50 engaged with tongue 52. This biasing force results from the fact that mounting sleeve 54 is placed on handle tube 15 at a location such that tongue 52 is slightly lower than rod 42 in a completely horizontal orientation of the rod. Thus, when tongue 52 extends down through eyelet 50, it stops rod 42 before it reaches a horizontal orientation such that rod 42 is inclined downwardly slightly as it extends from handle tube 14 to handle tube 15. Pivot rod 42 is selected from a slightly springy material so that this downward inclination creates a force in the pivot rod tending to relieve the downward inclination to cause the pivot rod to assume an unbiased horizontal orientation. This force is the source of the biasing means which causes rod 42 to have its free end 48 biased upwardly towards tongue 52. This biasing force, however, can be easily overcome by downward hand pressure until eyelet 50 disengages tongue 52 as shown in phantom in FIG. 7.

Figure 8:
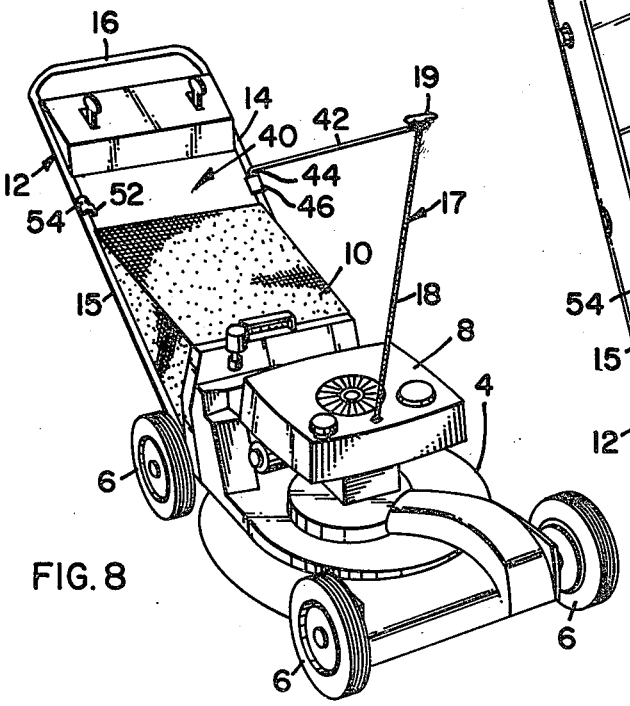
FIG. 8 is a perspective view of the lawn mower shown in FIG. 5, particularly illustrating the recoil starter rope and pivot rod of the zone start system located in a second position for allowing easy removal of the bagging attachment.

After eyelet 50 has been disengaged from tongue 52, pivot rod 42 can be swung through 180° to the position shown in FIG. 8, i.e. extending outwardly away from handle tube 14 in a direction clearing the area between handle tubes 14 and 15. In this position, the starter rope 18 no longer interferes with bagging attachment 10. Accordingly, bagging attachment 10 may be quickly and easily removed and the grass clippings dumped. It is apparent that all of the advantages pertaining to zone start system 20 apply equally to zone start system 40.

One aspect of both embodiments of the invention is that the pull grips 19 are located on the right hand handle tube 15. This is preferable because most operators are right handed and prefer such a location for the pull grip 19. However, if necessary the position of the elements in both embodiments could be reversed so that the pull grip 19 would be located on the left hand handle tube 14 for a left handed operator.

Various modifications of this invention will be apparent to those skilled in the art. Thus, the scope of this invention is to be limited only by the appended claims.

I claim:

1. An improved lawn mower of the type having a movable housing, an internal combustion engine located on the housing for powering a cutting element, a handle assembly that extends outwardly and rearwardly from the housing, wherein the handle assembly is U-shaped comprising spaced apart left and right handle tubes connected together adjacent their upper ends by a transversely extending handle member which the operator grips while guiding the housing, a rear bagging attachment releasably coupled to the housing in the area between the handle tubes and beneath the handle member for receiving and collecting cut particles, and a recoil starter on the internal combustion engine including an elongated starter rope having a pull grip at its outer end, wherein the improvement relates to a zone start system which comprises:

means for normally retaining the pull grip of the starter rope on one of the handle tubes of the handle assembly at a location which is accessible to an operator who is holding the handle member for easy starting of the engine, wherein the retaining means is placed on the handle tube at a location such that the starter rope extends in a straight line path from the engine to the retaining means and passes relatively closely above a portion of the bagging attachment such that the starter rope would be engaged by the bagging attachment during removal of the attachment, and wherein the retaining means includes means for releasing the pull grip from the one handle tube for movement of the starter rope to a non-interfering position with the bagging attachment when it is desired to remove the bagging attachment from the housing for dumping of the attachment.

2. An improved lawn mower of the type having a movable housing, an internal combustion engine located on the housing for powering a cutting element, a handle assembly that extends upwardly and rearwardly from the housing and is U-shaped comprising spaced apart handle tubes connected together by a transversely extending handle member which the operator grips while guiding the housing, a rear bagging attachment releasably coupled to the housing for receiving and collecting cut particles, and a recoil starter on the internal combustion engine including an elongated starter rope having a pull grip at its outer end, wherein the improvement relates to a zone start system which comprises:

means for normally retaining the pull grip of the starter rope on one of the handle tubes of the handle assembly at a location which is accessible to an operator who is holding the handle member for easy starting of the engine, wherein the retaining means includes means for releasing the pull grip from the one handle tube for movement of the starter rope to a non-interfering position with the bagging attachment when it is desired to remove the bagging attachment from the housing for dumping of the attachment, wherein the retaining means comprises an upwardly extending tang having a vertical slot, wherein the tang is fixed to and spaced in front of the one handle tube to define a grip receiving recess in which the pull grip is releasably contained with the starter rope extending through the slot of the tang, wherein both the grip receiving recess and slot are open at the top to allow the pull grip and starter rope to be disconnected therefrom by lifting the pull grip upwardly out of the slot, whereby the starter rope when so released may be moved to its non-interfering position.

3. An improved lawn mower of the type having a movable housing, an internal combustion engine located on the housing for powering a cutting element, a handle assembly that extends upwardly and rearwardly from the housing and is U-shaped comprising spaced apart handle tubes connected together by a transversely extending handle member which the operator grips while guiding the housing, a rear bagging attachment releasably coupled to the housing for receiving and collecting cut particles, and a recoil starter on the internal combustion engine including an elongated starter rope having a pull grip at its outer end, wherein the improvement relates to a zone start system which comprises:

means for normally retaining the pull grip of the starter rope on one of the handle tubes of the handle assembly at a location which is accessible to an operator who is holding the handle member for easy starting of the engine, wherein the retaining means includes means for releasing the pull grip from the one handle tube for movement of the starter rope to a non-interfering position with the bagging attachment when it is desired to remove the bagging attachment from the housing for dumping of the attachment, wherein the retaining means comprises a pivot rod pivotally secured to the handle assembly having a free end which supports the pull grip of the starter rope, and further including means for releasably latching the free end of the pivot rod to the one handle tube for starting of the engine, whereby the pivot rod when unlatched from the one handle tube can be swung to its non-interfering position for dumping of the bagging attachment.

4. An improved lawn mower as recited in claim 3, wherein the free end of the pivot rod includes an eyelet through which the starter rope extends with the pull grip being supported on top of the eyelet.

5. An improved lawn mower as recited in claim 4, further including a downwardly extending tongue fixedly secured to the one handle tube at a location such that the tongue may be inserted through the eyelet of the pivot rod to constitute the latching means for the free end of the pivot rod.

6. An improved lawn mower as recited in claim 5, further including a means for biasing the pivot rod toward the tongue to more firmly engage the tongue in the eyelet.

7. An improved lawn mower as recited in claim 6, wherein the pivot rod is pivotally secured to the other handle tube such that when the free end of the rod is latched to the one handle tube the pivot rod extends between the handle tubes.

8. An improved lawn mower as recited in claim 7, wherein the tongue is located on the one handle tube at a location such that when it is engaged in the eyelet the pivot rod is slightly inclined below the horizontal as it extends between the handle tubes to cause an upward biasing force in the pivot rod which constitutes the biasing means.

* * * * *